United States Patent [19]

Strom et al.

[11] 4,179,222

[45] Dec. 18, 1979

[54] FLOW TURBULENCE GENERATING AND MIXING DEVICE

[75] Inventors: John R. Strom; George W. Finch; Harvey W. Weyrick, all of Seattle, Wash.

[73] Assignee: Systematix Controls, Inc., Seattle, Wash.

[21] Appl. No.: 868,490

[22] Filed: Jan. 11, 1978

[51] Int. Cl.[2] ..... B01F 5/00

[52] U.S. Cl. ..... 366/337; 138/38; 138/42

[58] Field of Search ..... 366/336, 337, 338; 138/37, 38, 39, 42; 181/279, 280

[56] References Cited

U.S. PATENT DOCUMENTS

| | | | |
|---|---|---|---|
| 3,051,453 | 8/1962 | Sluijters | 366/337 |
| 3,086,395 | 4/1963 | York | 138/37 X |
| 3,664,638 | 5/1972 | Grout et al. | 366/338 |

FOREIGN PATENT DOCUMENTS

| | | | |
|---|---|---|---|
| 2459355 | 7/1975 | Fed. Rep. of Germany | 366/338 |

*Primary Examiner*—Philip R. Coe

*Attorney, Agent, or Firm*—Christensen, O'Connor, Johnson & Kindness

[57] ABSTRACT

A device for generating special turbulence patterns in fluids flowing in pipes, such as for mixing, promoting chemical reactions, or accelerating the transfer of heat to or from the fluid through the pipe wall. Two or more sets of flow dividers are mounted in the pipe, each set including a first and second flow divider with septum panel elements that overlap longitudinally of the pipe. The first flow divider septum elements mutually diverge downstream in a selected longitudinal plane in longitudinally overlapping relationship with septum elements of the second flow divider mutually diverging upstream in a different longitudinal plane so as to divert the fluid in such manner that the flow regions adjoining the pipe wall are caused to exchange positions with flow regions in the vicinity of the pipe axis. By reversing the relative incline angles of the septum elements of corresponding flow dividers of successive sets alternately when a succession of two or more sets are installed in direct series, the desired effects are augmented.

3 Claims, 10 Drawing Figures

Fig. 6
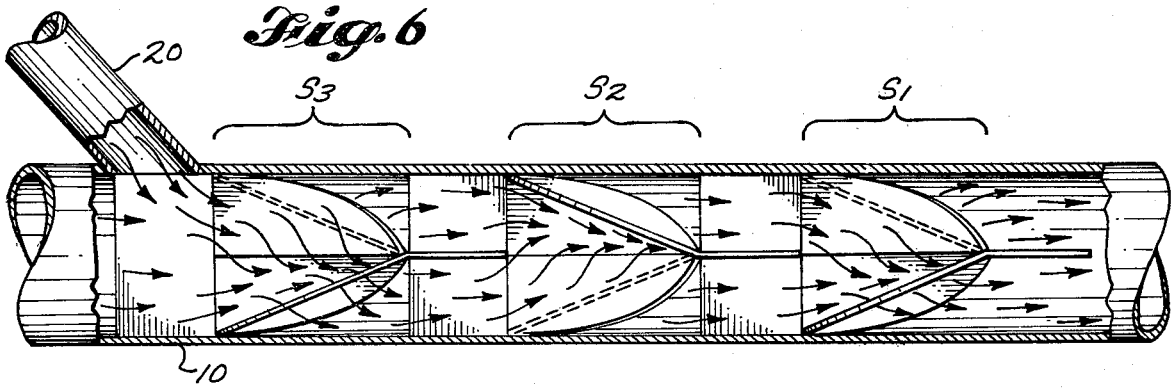
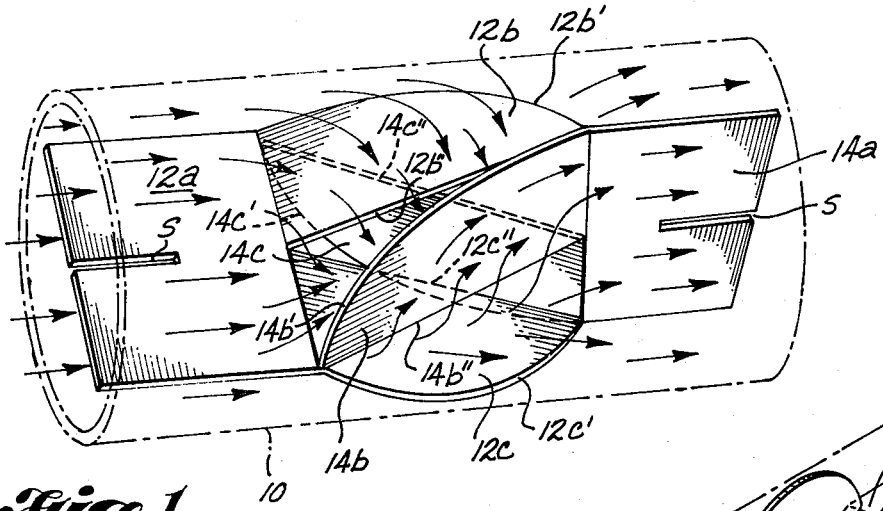
Fig. 1
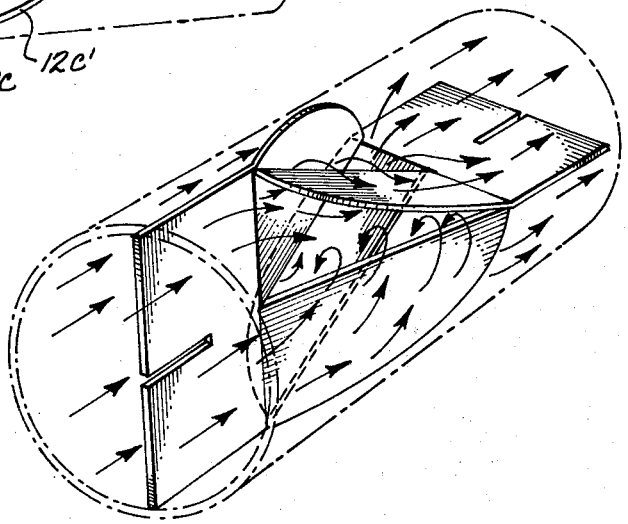
Fig. 2
Fig. 8
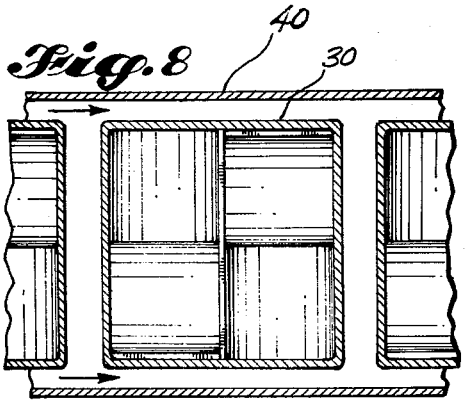
Fig. 9
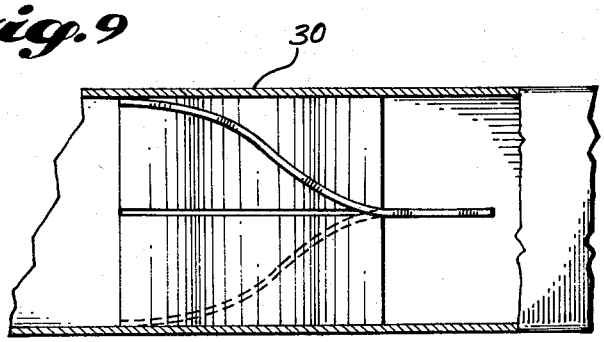

FLOW TURBULENCE GENERATING AND MIXING DEVICE

BACKGROUND OF THE INVENTION

This invention relates to turbulence producing and flow mixing devices for incorporation in pipes and other ducts so as to promote mixing of materials, chemical reactions, or heat exchange through the pipe wall. The invention is herein illustratively described by reference to the presently preferred embodiments thereof; however, it will be recognized that certain modifications and changes therein with respect to details may be made without departing from the essential features involved.

Streams of materials flowing in pipes or ducts may include components that are solid, liquid or gaseous, or combinations thereof. They may have characteristics which allow or require chemical reactions one with another or simply mixing. In some cases the objective of creating turbulence is simply to promote the exchange of heat between the material flowing in the pipe and a medium surrounding the pipe or comprising the pipe wall itself, for that matter. A broad object of this invention is to devise a stationary means that can be mounted within a pipe or other duct to create special turbulence flow patterns therein as to maximize the degree of mixing or the degree of heat transfer to or from the material; more specifically to promote positional interchanges of material flowing along the region adjacent the pipe wall with material flowing along the central region within the pipe and of achieving this without unnecessarily impeding flow through the pipe.

A related object is to promote uniformity and thoroughness of mixing and/or heat transfer in a relatively short length section of pipe incorporating one or more sets of the cooperating flow dividers.

Previous designs of systems that have been utilized to create turbulence or mixing in pipes tend to be bulky and space consuming for the amount of turbulence or mixing effect achieved. In addition, they tend to produce excessive pressure drops along the pipe run for the amount of mixing or heat transfer created. Prior art of varying background interest in relation to this invention is represented by disclosures in the following United States patents:

| | |
|---|---|
| 3,652,061 | Chisholm |
| 3,286,992 | Armeniades, et al |
| 3,404,869 | Harder |
| 3,583,678 | Harder |
| 3,664,638 | Grout, et al |
| 3,704,006 | Grout, et al |

There are a number of applications for this invention in industrial processes. For example, in some cases it is desirable to create uniform dispersion of insoluble gases or partially soluble gases in a fluid stream flowing in a pipe in order to promote chemical reactions or absorption of the gas. In other cases, one or more liquids and solid particles are to be mixed or the particles are to be dissolved in the liquids, with or without attendant chemical reaction. In still other cases, premixed materials are to be reacted during flow, with or without promotion or retardation of the reaction process due to application of heat or withdrawal of heat from the materials. In such cases, the invention is useful in accelerating and promoting uniformity in the rate of mixing, reacting and/or heat addition or withdrawal from the mixture by transfer through the pipe wall.

A further object of this invention is to provide a compact and efficient means for admixing two or more components of flow in a stream of material, or for promoting turbulence for other purposes, such as for heat exchange purposes.

A further object is to devise such a device that promotes the exchange of positions of medium flowing in the pipe such that the material adjacent the pipe wall is exchanged with the material flowing near the pipe axis, back and forth in all directions as the flow progresses through the pipe past the turbulence creating sets of flow dividers.

SUMMARY OF THE INVENTION

In accordance with this invention as herein disclosed, one or more sets of first and second flow dividers, each including a pair of mutually divergent septum panel elements, are mounted within the pipe or other duct in mutual longitudinally overlapping relationship, those of the first flow divider diverging downstream and those of the second flow divider diverging upstream, and in respectively different planes parallel to or containing the axis of the pipe. Preferably the flow dividers, including the spectum panel elements thereof, extend close to or in contact with the pipe wall along the radially outer edge of such elements so as to crowd the incident longitudinal flow in a spiral or peripheral sense inwardly whereupon such flow passes through the overlapped convergentdivergent gaps formed between the oppositely divergent septum panel elements of the cooperating flow dividers in each set. Thus, the flow dividers impart transverse velocity components to the flowing material such that the radially outer portions are caused to flow at a much higher velocity than the radially inner portions in crossing the radially inner edge surfaces of the septum panel elements at said gaps. Not only do the cooperating sets of flow dividers effect rapid and thorough mixing by the extremely high degree of turbulence they create in the flow, but they cause material flowing along the pipe wall region to exchange positions with material flowing along the central region of the pipe.

When a succession of such flow divider sets are arranged in direct series in the pipe, alternately reversing the incline angles of flow divider septum elements occupying corresponding positions in successive sets augments the effects and also renders the mixing system more completely insensitive to rotative orientation of the flow dividers within the pipe. This offers an advantage in total systems wherein the mixing device cooperates with external elements that may present an effect on the pipe or receive an effect from the pipe varying as a function of position about the pipe axis.

By varying the angle of divergence of the septum panel elements, the degree of turbulence as well as the pressure drop encountered by the flowing material for each set of flow dividers encountered, may be varied in order to suit varying design requirements. Likewise, the number of sets of flow dividers utilized in a given system, determining the length of flow path along the containment pipe required, may be varied to suit different requirements.

These and other objects and features of the invention will become more fully evident as the description proceeds by reference to the accompanying illustrations of the presently preferred embodiments.

BRIEF DESCRIPTION OF DRAWINGS

FIG. 1 is an isometric view of the flow turbulating mixer in a pipe or duct of circular cross section shown by broken lines, with one set of first and second flow dividers, and with arrows depicting in approximate manner the unique fluid flow patterns produced thereby.

FIG. 2 is a view similar to FIG. 1 seen from a somewhat different aspect angle.

FIG. 6 is a longitudinal sectional view of a length of circular duct carrying a fluid or material, with a branch line to inject a second fluid or material for admixture with the first fluid or material, the duct downstream of the branch having a succession of sets of first and second flow dividers to admix the materials.

FIG. 8 shows a portion of a heat exchanger taken in cross section incorporating pipes or ducts square in cross section, the ducts having sets of flow dividers in which the septum panel elements are curved as in FIG. 7.

FIG. 9 is a longitudinal section of a length of the pipe shown in FIG. 8 depicting one set of flow dividers in the pipe.

DETAILED DESCRIPTION WITH REFERENCE TO THE DRAWINGS

Figure 7:
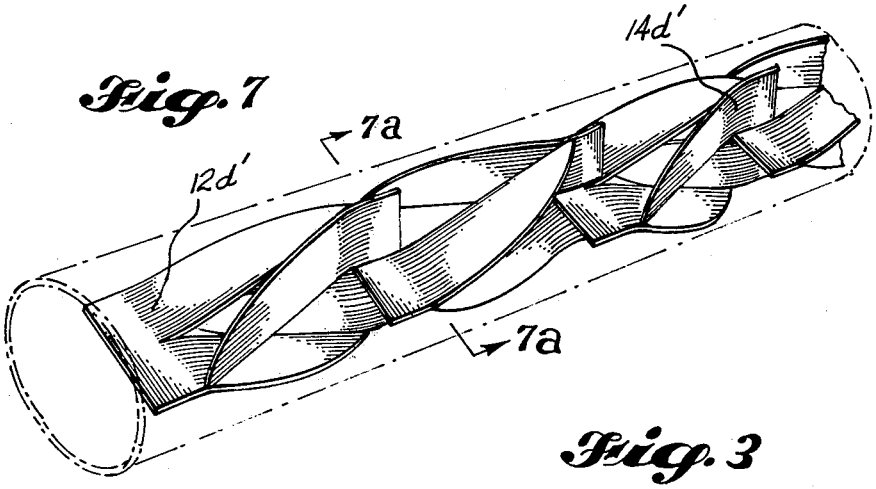
FIG. 7 is an isometric view of a round pipe or duct of oval cross section shown by broken lines, with a series of sets of first and second flow dividers mounted therein and with the septum panel elements of each flow divider longitudinally curved from their common base panel rather than being flat as in the embodiments depicted in the above-mentioned figures.
Figure 7A:
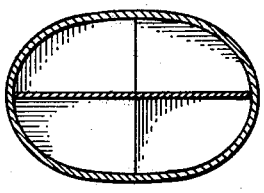
FIG. 7a is a transverse sectional view taken on line *7a—7a* in FIG. 7.
Figure 3:
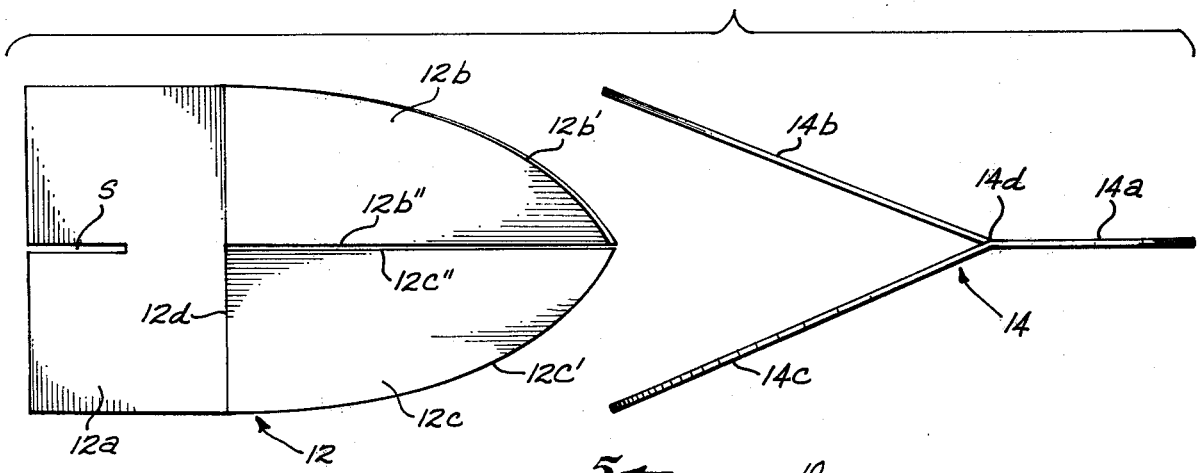
FIG. 3 is an enlarged view of the flow dividers of FIGS. 1 and 2 physically separated preparatory to assembly by moving them together into longitudinally overlapped relationship, the two dividers in this instance being disposed mutually at right angles, with one shown in full face view of its septum element common base panel.
Figure 4:
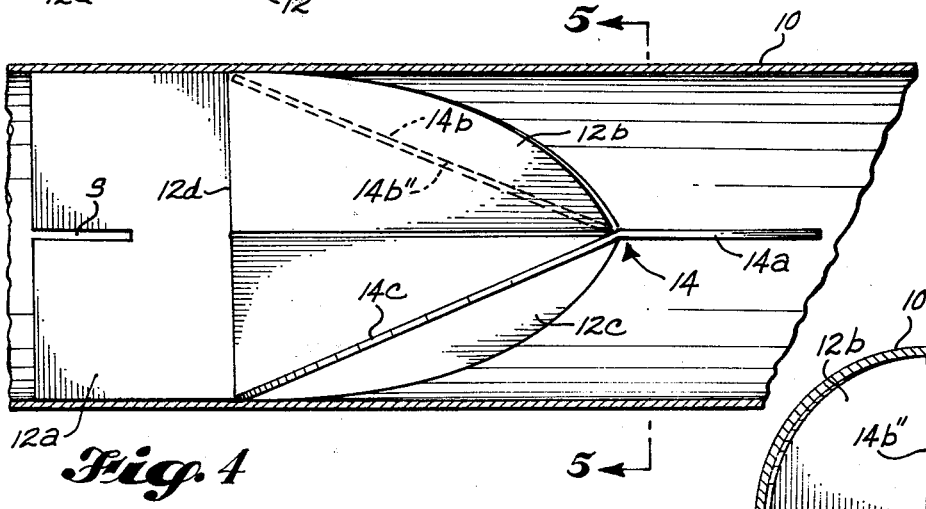
FIG. 4 is a sectional side view of a length segment of circular duct with the dividers of FIG. 3 assembled and operatively mounted therein.
Figure 5:
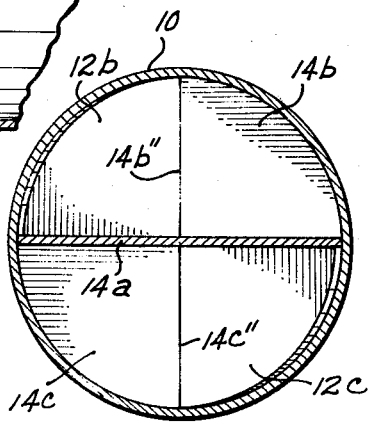
FIG. 5 is a transverse sectional view taken on line 5—5 in FIG. 4.

Referring first to FIGS. 1–5, the duct or pipe 10 in this example is circular. The first and second flow dividers 12 and 14 comprising a set each consist of a base panel 12*a* and 14*a*, respectively, and two longitudinally extending oppositely divergent septum panel elements 12*b*, 12*c* and 14*b*, 14*c*, respectively. Septum panel elements 12*b* and 12*c* diverge mutually at an acute angle from a bend line 12*d* at their common boundary with base panel 12*a*. Elements 14*b* and 14*c* are similarly related to each other, to base panel 14*a* and to bend line 14*d*. The septum panel elements are flat. Their relatively outer edges 12*b*′ and 12*c*′ are curved so as to follow a spiral line proximate to and preferably contacting the inside periphery of the pipe; the same being true of the edges 14*b*′ and 14*c*′ of divider 14. The mutually adjacent longitudinal inner edges 12*b*″ and 12*c*″ of septum elements 12*b* and 12*c* in this case are straight and, before the septum elements are bent, are mutually parallel, such as with the septum elements being formed by a single longitudinal slit in a flat sheet of material. Inner edges 14*b*″ and 14*c*″ of divider 14 are similarly formed. A centered longitudinal slot S in the end of each base panel 12*a* and 14*a* permits interfitting of the base panels of the flow dividers of adjoining sets, such as sets $S_1$, $S_2$, and $S_3$, as in FIG. 6.

With reference to FIGS. 1 and 2, flow lines are depicted that approximate the diverting and mixing effect of the cooperating septum elements and base panels. The collimating effect of the tube wall and intersecting axial plane base panels alternates with the deflecting effects of the angled septum panel elements. As the flow encounters the septum panel elements 12*b*, for example, the flow is deflected outward toward the tube wall, which thereupon crowds the flow inwardly and peripherally toward and through the widening gap between the inner septum edges 12*b*″ and 14*b*″. At the same time the flow encountering septum element 14*b* is deflected peripherally and inwardly also toward and through said gap, and in the process into mergence with the deflected flow directed by septum element 12*b*. In parallel relationship with this flow, the widening relief space afforded by the divergence of septum elements 12*b* and 12*c* in relation to edge 14*b*″ provides an escape path for the convergence or crowding effects produced by elements 12*b* and 14*b*. Through this escape path the fluid passes along and around the edge 14*b*″ to flow transversely inwardly and along the aft face of panel 14*b*. The same escape flow occurs around the edge 14*c*″ creating mergence with the escape flow around edge 14*b*″. As a result the total flow passing the set of flow dividers is so directed that the portions initially passing along the pipe wall and the portions near the central region within the pipe are caused to exchange positions and in the process thereof, to intermix. The process is repeated in reverse as the flow encounters the next succeeding set of flow divider elements in a series. In operation it will be observed that the arrangement achieves turbulence and mixing effect not merely by changing the directions of flow into intersecting paths but also by differential velocity effects created. Thus, the transversely directed components of inwardly deflected flow are higher starting adjacent the pipe wall than they are at radially more inward locations. These differentials in velocity produce shear effects and highly turbulent flow as a result.

In FIG. 6, wherein three such sets are shown, the fluid entering pipe 10 at one end is first joined by inflow from branch pipe 20, whereupon their combined flow undergoes the combined mixing and position interchanging functions three times in immediate succession. Preferably the angling of the septum panel elements of corresponding flow dividers of successive sets are alternately reversed as depicted. This augments the discribed effects and renders the system insensitive even more to rotational orientation of the flow dividers relative to cooperating external devices such as adjacent elements or regions within a heat exchanger, or branch pipes that introduce materials or remove materials at discrete locations. The point is that the mixing and turbulence effects achieved by a series of flow divider sets with alternately opposite angling of the system elements in successive sets is further improved by that arrangement over one in which incline direction of the elements of the successive sets are unchanged. Of course, any desired number of sets may be incorporate in a pipe run to achieve the desired degree of mixing therein. With this invention, the degree of mixing that occurs is high by comparison with that achieved in former systems for the length of pipe run required to incorporate the mixing flow dividers. The reduced system cost and the reduced space requirement to achieve thorough mixing are thus important advantages of the invention.

FIGS. 7 and *7a* illustrate applicability of this invention to a pipe of oval or other round but non-circular cross section. Also in these figures the divergent pairs of septum elements are curved in shape rather than flat as depicted in the example of FIGS. 1–5. Gradual curvatures 12*d'* and 14*d'* avoiding the abrupt bend at lines 12*d* and 14*d* provide somewhat less resistance and less pressure drop at the discontinuities.

In FIGS. 8 and 9, the invention is shown applied with curved septum element flow dividers incorporated in a pipe 30 of square or rectangular cross section. FIG. 8 depicts a plurality of pipe 30 incorporated in a heat exchange chamber defined by jacket 40 adapted to enclose a second fluid (hot or cold) in heat exchange relationship with the walls of the flow mixing pipes 30. For such applications the turbulence mixing and position-exchanging effects of the flow divider elements within pipes 30 assures maximum rate of contact of heat transmittal through the walls of such pipes so as to achieve maximum uniform rate of temperature change of such fluid in a given size of the heat exchanger.

These and other applications of the invention, including variations in the detailed equivalent embodiments thereof, are intended to be embraced within the scope of the claims that follow.

The embodiments of the invention in which an exclusive property or privilege is claimed are defined as follows:

1. In combination with an elongated tubular duct adapted to conduct fluid axially therein, turbulent mixing apparatus comprising flow divider means fixedly mounted in said duct comprising a plurality of pairs of elongated septum panels mounted at successively spaced locations along said duct, the respective panels of each such pair having substantially planar first end portions constituting a minor fraction of the lengths of such panels and disposed in longitudinally overlapping and mutually transverse relationship, intersecting along the duct axis, said septum panels of each pair further having second end portions projecting longitudinally from the respective first end portions and each including two longitudinally coextending panel elements transversely angled in mutually divergent relationship, with inner edges forming a progressively widening gap between them along the duct axis and with outer edges extending along the duct interior wall, the angling of the two panel elements of one such second end portion being in the opposite hand from that of the two panel elements of the other second end portion as viewed in the same direction along the duct, the transversely angled panel elements of each septum panel pair longitudinally overlapping those of respectively adjacent septum panel pairs.

2. The combination defined in claim 1 wherein the first portions of the successive septum panel pairs are substantially coplanar.

3. The combination defined in claim 2 wherein the tubular duct is circular in internal cross-section.

* * * * *